US005806545A

United States Patent [19]

Ko

[11] Patent Number: 5,806,545

[45] Date of Patent: Sep. 15, 1998

[54] CONTROL CORDS OF AN AUTOMATIC UMBRELLA

[76] Inventor: Chin-Sung Ko, No. 27-1, Lane 188, Sec. 3, Chin Mar Road, Changhua, Taiwan

[21] Appl. No.: 864,454

[22] Filed: May 28, 1997

[51] Int. Cl.[6] ..... A45B 25/14

[52] U.S. Cl. ..... 135/24; 135/28

[58] Field of Search ..... 135/22–24, 28, 135/38, 39, 25.1

[56] References Cited

U.S. PATENT DOCUMENTS

| | | | |
|---|---|---|---|
| 250,942 | 12/1881 | Miniere | 135/24 |
| 680,661 | 8/1901 | Hunt | 135/24 |
| 706,352 | 8/1902 | Smith . | |
| 2,568,362 | 9/1951 | Primavera | 135/22 X |
| 4,860,776 | 8/1989 | McQuain . | |
| 4,928,718 | 5/1990 | Apple . | |
| 4,977,913 | 12/1990 | Meyman . | |
| 5,174,319 | 12/1992 | Chou et al. . | |
| 5,232,004 | 8/1993 | Wu . | |
| 5,626,160 | 5/1997 | Ko . | |

FOREIGN PATENT DOCUMENTS

| | | | |
|---|---|---|---|
| 0200571 | 11/1986 | European Pat. Off. | 135/24 |

*Primary Examiner*—Lanna Mai

*Attorney, Agent, or Firm*—Morton J. Rosenberg; David I. Klein; Jun Y. Lee

[57] ABSTRACT

The present invention relates generally to an umbrella, and more particularly to an umbrella provided with improved control cords by which the automatic opening and the automatic closing of the umbrella are capable of being controlled, and under the improved control cords providing, they have only a few portions exposed and the outer ends are connected within the runner and hidden by an elastic ring. It is thus making sure for safety and a cover of the umbrella will not be easily broken as a prior one.

3 Claims, 7 Drawing Sheets

CONTROL CORDS OF AN AUTOMATIC UMBRELLA

FIELD OF THE INVENTION

The present invention relates generally to an umbrella, and more particularly to an umbrella provided with improved control cords by which the automatic opening and the automatic closing of the umbrella are capable of being controlled, while the control cords are provided with a safe position to prevent from drawbacks.

BACKGROUND OF THE INVENTION

A prior automatic umbrella uses a spring set and a control member within a handle accompanying by a retaining piece which connects with a pair of control cords extending outside to pass through a runner and combining with an upper rib holder to control an automatic opening or closing of the umbrella. Most improvement focuses on the control member but the control cords are always the same. The known structure of the prior control cords have their inner ends connecting with the retaining piece and directly extend outside to connect their outer ends with the upper rib holder. Therefore, a large part of the control cords are exposed. It might be broken easily when using and the outer connecting ends on the upper rib holder are more possible to damage a cover of the umbrella.

SUMMARY OF THE INVENTION

The primary objective of the present invention is to provide an umbrella capable of overcoming the drawbacks of the prior art umbrella disclosed. The umbrella of the present invention comprises an improved structure of control cords which are suitably provided within the shaft tube of the umbrella and the outer ends of the cords are connected with each other and hidden by a ring for preventing from damage.

The foregoing features and advantages of the present invention will be more readily understood upon a thoughtful deliberation of the following detailed description of an embodiment of the present invention in conjunction with the accompanying drawings.

DETAILED DESCRIPTION OF THE EMBODIMENT

Figure 1:
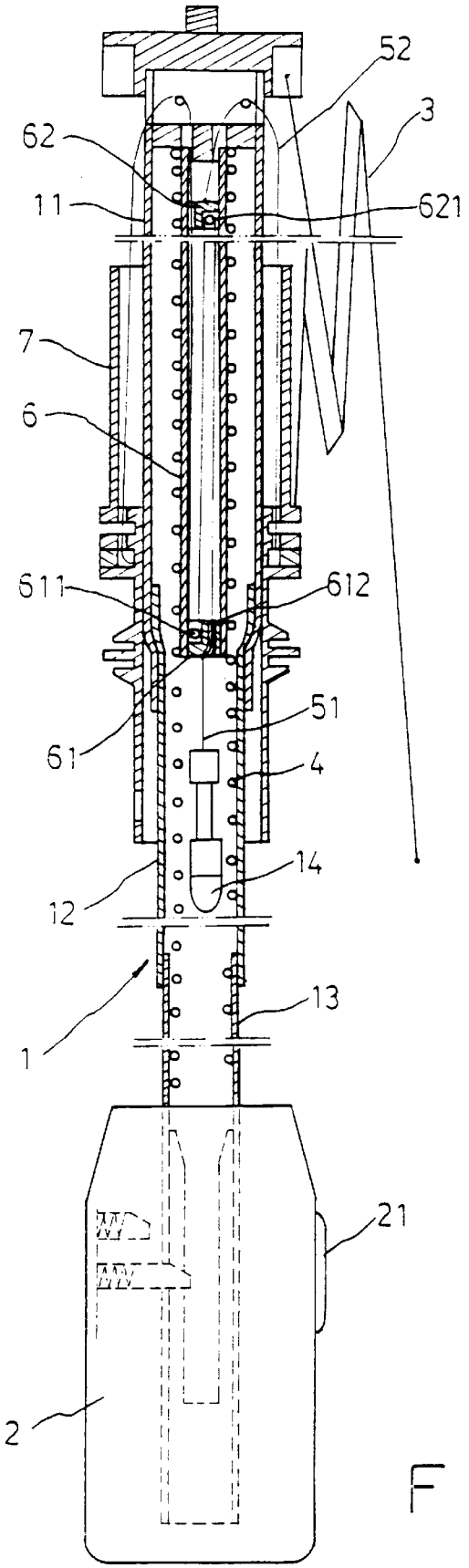
FIG. 1 shows a cross-sectional view of a three folded ribs umbrella in a closed structure according to the present invention.

As shown in all drawings provided herewith, an umbrella embodied the present invention is composed of a shaft 1 having an outer tube 11, a middle tube 12, and an inner tube 13, a handle 2, a rib frame 3, and an inner spring set 4, and it utilizes a button 21 of the handle 2 to control an engagement or a disengagement with a retaining piece 14 for an opening or a closing of the umbrella, in which the principle and the movement of each member are similar to a prior art and will not be detailedly disclosed thereafter.

Figure 2:
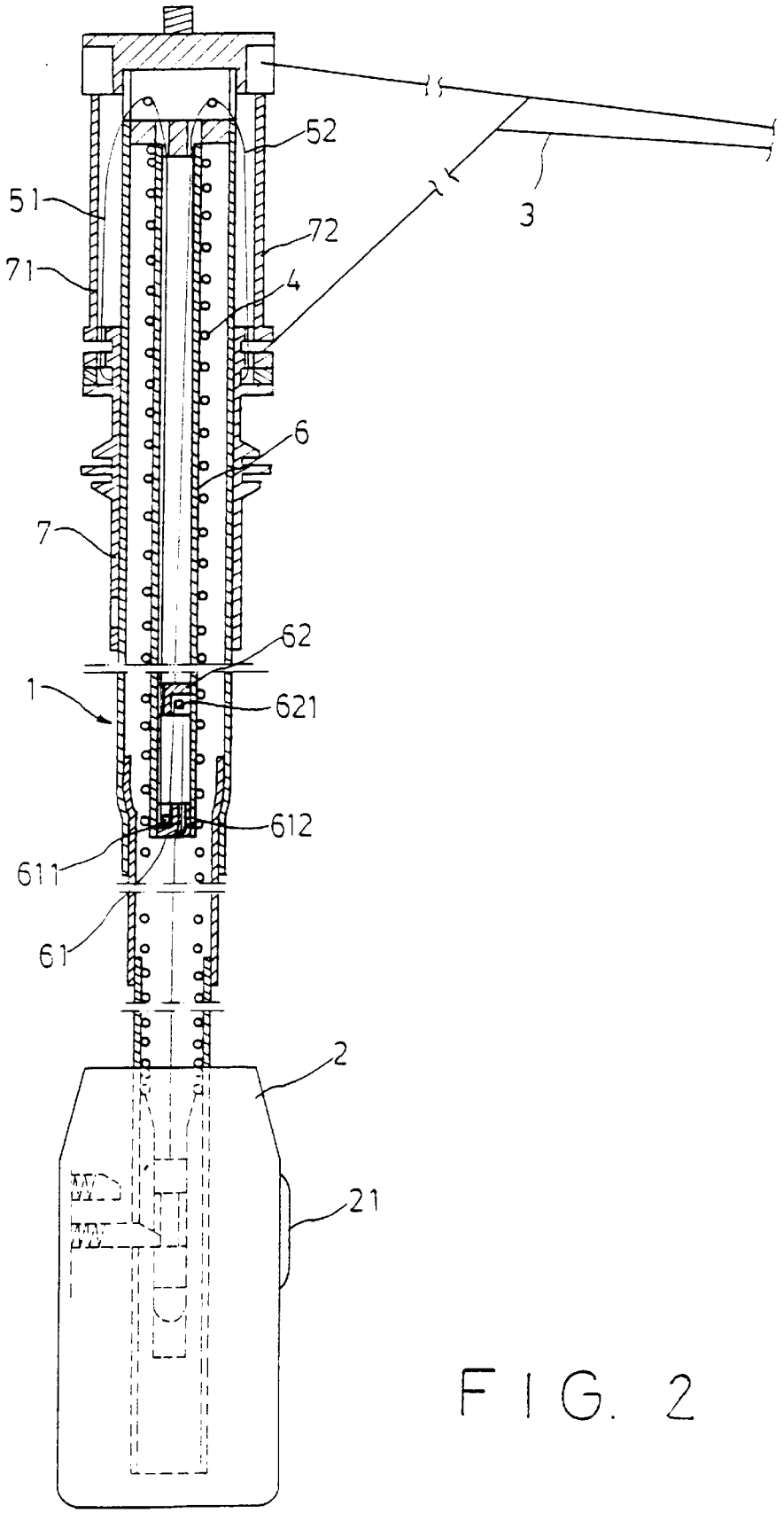
FIG. 2 shows a cross-sectional view of FIG. 1 in a opened structure according to the present invention.
Figure 6:
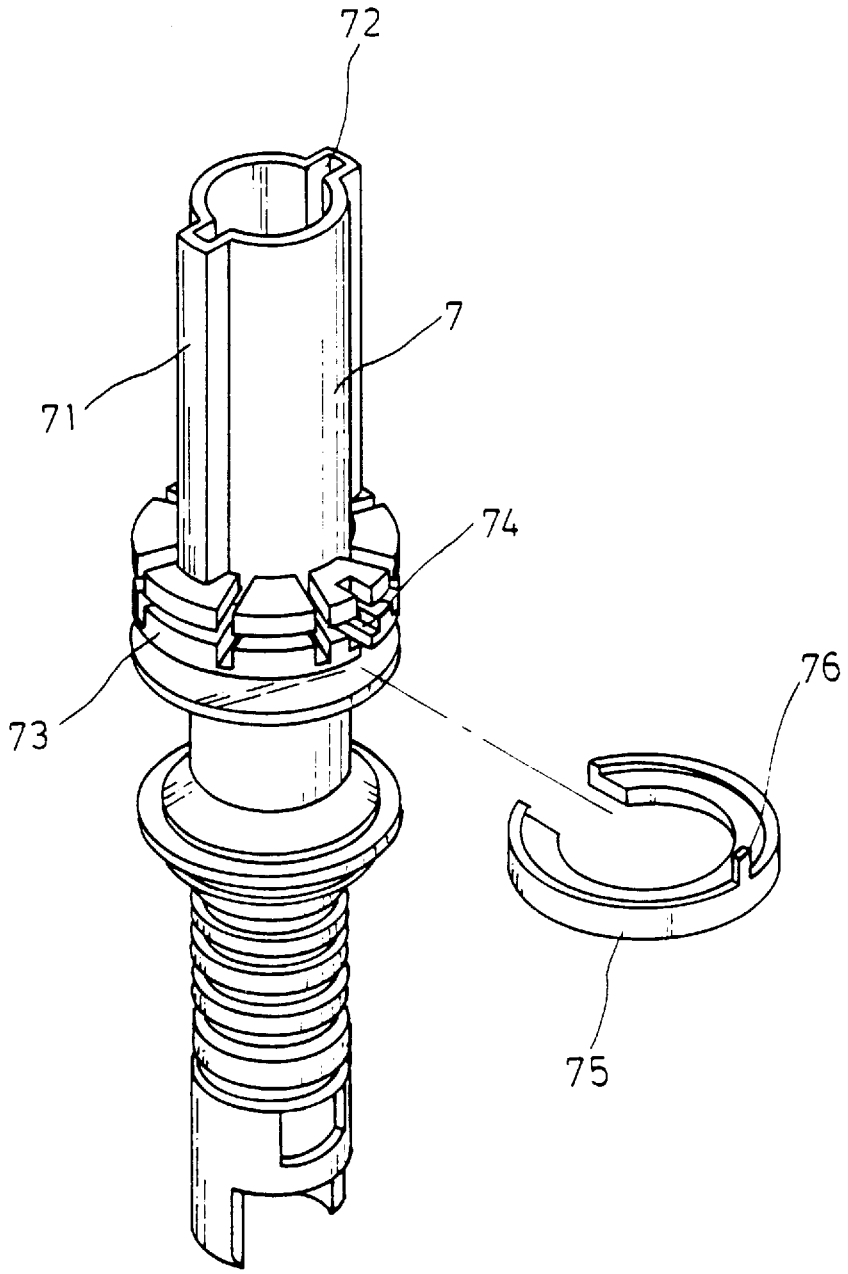
FIG. 6 shows a perspective view of a runner in accordance with the present invention.
Figure 7:
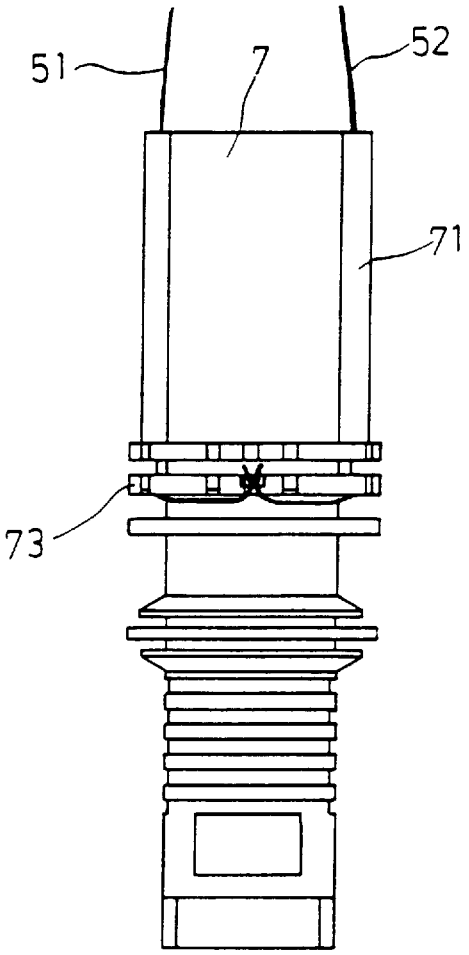
FIG. 7 is a schematic plan view showing the runner with the control cords of the umbrella of the present invention.

As shown in FIGS. 1 and 2, the characteristic of the present invention is to provide a set of control cords with an improved connection in the shaft 1. It can be seen that an inner sleeve 6 within the shaft 1 is provided with a lower fixed member 61 in its lower end and a slidable member 62 in the top end. Each of the two members 61, 62 is provided with an axis 611 and 621. A long control cord 51 has its inner end connected with the retaining piece 14 and has its outer end passing through a channel 612 of the fixed member 61, extending to the axis 621 of the slidable member 62, then turning downward around the axis 611 of the member 61, and extending outward from the top of the shift 1, while the outer end of the long control cord 51 connects to a runner 7 of the umbrella. Another short control cord 52 has its inner end connected with the slidable member 62 and its outer end extending directly outward from the top of the shaft 1 and connecting to the other side of the runner 7. Please refer to FIGS. 6 and 7, the runner 7 of the present invention has two projections 71 on both sides, that forms a channel 72 in each projection 71. Therefore, the two control cords 51, 52 are passing through the channels 72 and curving forward under a rib base 73 of the runner 7 to let the outer ends of them being twisted and received in a groove 74 of the runner 7. An elastic ring 75 is provided to engage with the runner 7 under the rib base 73 and covers the control cords 51, 52 therein, while a projection 76 is formed on the ring 75 which is capable of engaging within the groove 74 and hiding the twisted cord ends for a safe purpose.

Under the improved control cords providing, they have only a few portions exposed and the outer ends are connected within the runner 7 and hidden by the elastic ring 76. It is thus making sure for safety and security. The cover of the umbrella will not be easily broken as a prior one.

Figure 3:
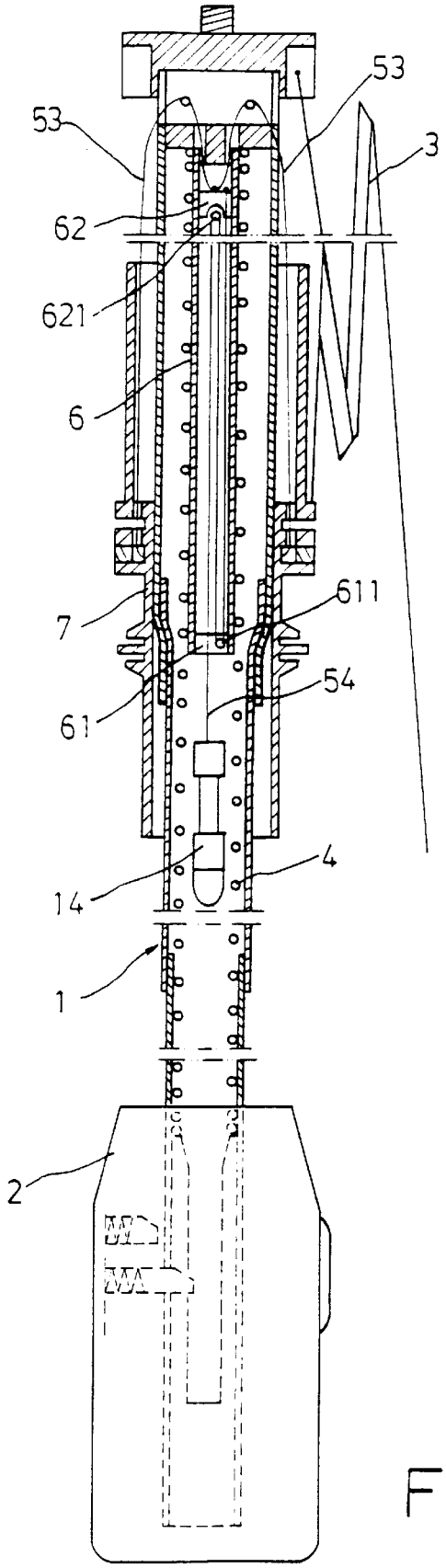
FIG. 3 shows a cross-sectional view of another three folded ribs umbrella in a closed structure according to the present invention.
Figure 4:
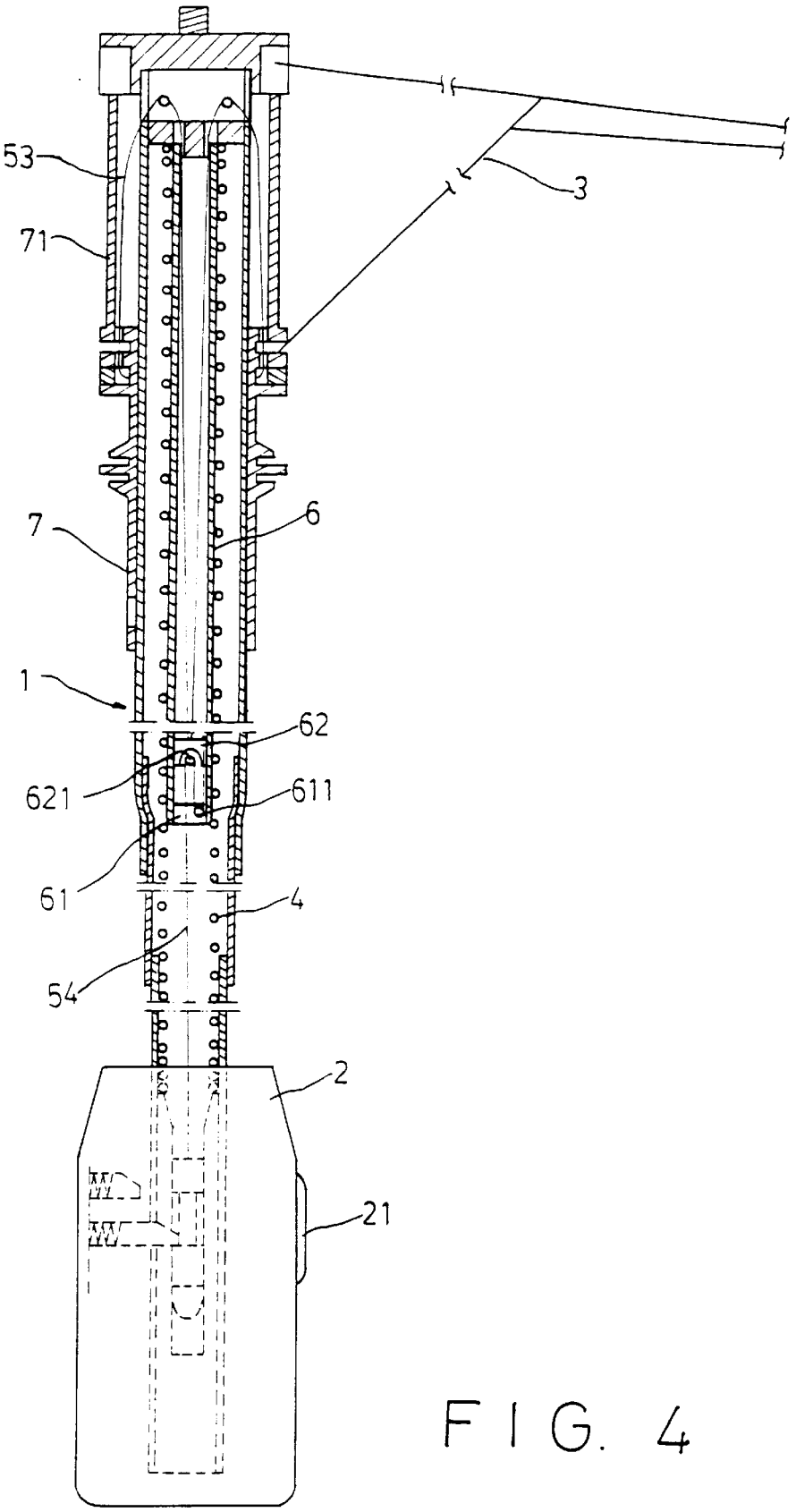
FIG. 4 shows a cross-sectional view of FIG. 3 in a opened structure according to the present invention.
Figure 5:
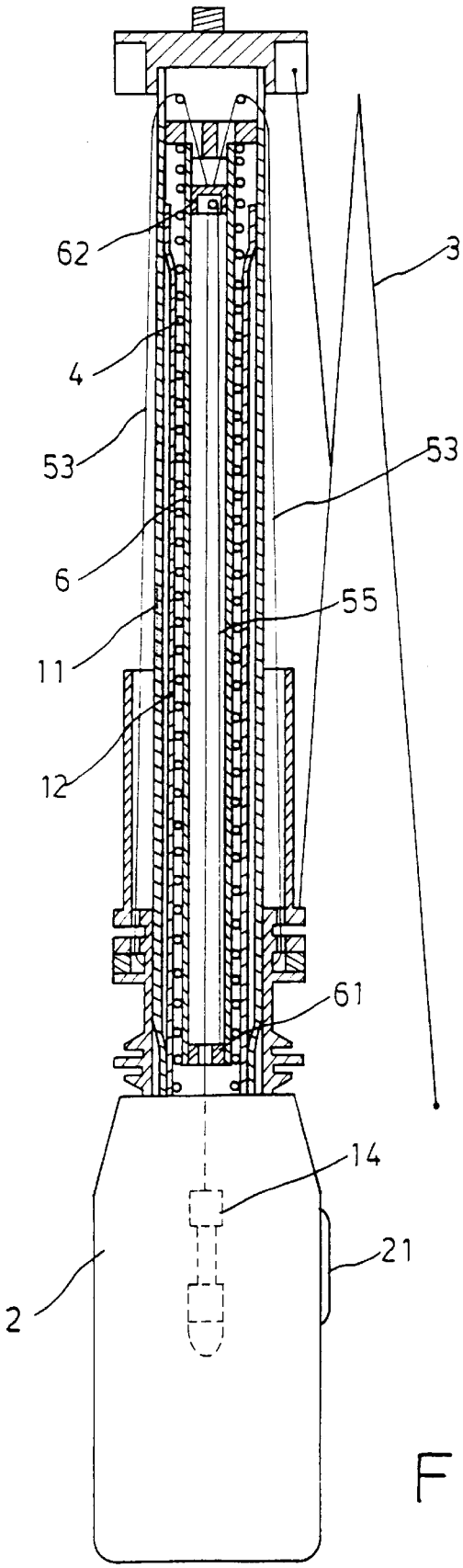
FIG. 5 shows a cross-sectional view of a two folded ribs umbrella according to the present invention.

Referring to FIGS. 3 and 4, they show another embodiment according to this invention which provides a pair of outer control cords 53 having their inner end connected with the slidable member 62 and their outer ends connected to the runner 7 as aforesaid structure. It is characterized in that an inner control cord 54 is provided in the inner sleeve 6. The inner control cord 54 has its one end connected with the retaining piece 14 and the other end turning around two axes 621, 611 and upward to connect with the slidable member 62. It has the same improvement. As shown in FIG. 5, it shows an embodiment of this invention used as a two folded ribs umbrella. Since it only needs a shorter preset length when the umbrella opens or closes, a shorter inner control cord 55 is provided to turn around the axis 621 and to connect with the fixed member 61 for operating of umbrella.

What is claimed is:

1. An umbrella comprising a shaft, a handle, a rib frame, and an inner spring set, and utilizing a button to control an engagement or a disengagement with a retaining piece for an opening or a closing of the umbrella, and characterized in that:

An inner sleeve within the shaft is provided with a lower fixed member in its lower end and a slidable member in the top end, and each of the two members being provided with an axis;

A long control cord having its inner end connected with the retaining piece and its outer end passing through a channel of the fixed member, extending to the axis of the slidable member, then turning downward around the axis of the member, and extending outward from the top of the shift, while the outer end of the long control cord connects to a runner of the umbrella;

Another short control cord having its inner end connected with slidable member and its outer end extending directly outward from the top of the shift and connecting to the other side of the runner; the runner having two projections on both sides forming a channel in each projection, and the two control cords passing through the channels and curving forward under a rib base of the runner to let the outer ends of them being twisted and received in a groove of the runner; and An elastic ring being provided to engage with the runner under the rib base and covering the control cords therein, while a projection being formed on the ring which is capable of engaging within the groove and hiding the twisted cord ends for a safe purpose.

2. The umbrella as claimed in claim 1, wherein a pair of outer control cords being provided which having their inner end connected with the slidable member and their outer ends connected to the runner, and an inner control cord being provided in the inner sleeve having its one end connected with the retaining piece and the other end turning around two axes and upward to connect with the slidable member.

3. The umbrella as claimed in claim 1, wherein a shorter inner control cord being provided to turn around the axis of the slidable member and to connect with the fixed member for operating of a two folded ribs umbrella.

* * * * *